United States Patent [19]

Colvin et al.

[11] 4,412,457

[45] Nov. 1, 1983

[54] IN-LINE ENGINE CRANKING MOTOR DRIVE HAVING REDUCTION GEAR SET

[75] Inventors: Jack A. Colvin; John M. McClellan, both of Anderson, Ind.

[73] Assignee: General Motors Corporation, Detroit, Mich.

[21] Appl. No.: 258,685

[22] Filed: Apr. 29, 1981

[51] Int. Cl.[3] ..... F02N 15/06

[52] U.S. Cl. ..... 74/7 A; 74/7 E

[58] Field of Search ..... 74/6, 7 R, 7 A, 7 E; 290/38 R, 38 C, DIG. 1

[56] References Cited

U.S. PATENT DOCUMENTS 2,562,568 7/1951 Nardone ..... 74/810

2,578,094 12/1951 Sears ..... 74/7 A 2,696,121 12/1954 Schneider et al. ..... 74/7 R 3,209,603 10/1965 Rodriguez ..... 74/7 A

*Primary Examiner*—Allan D. Herrmann

*Attorney, Agent, or Firm*—Mark A. Navarre

[57] ABSTRACT

A compact in-line cranking motor drive having a planetary reduction gear set. The cranking motor has a hollow armature shaft for driving the sun gear of the gear set and the planet carrier of the gear set is connected to drive a central shaft, which is disposed within the hollow armature shaft and supported at both ends by the drive housing. A one-way overrunning clutch shiftably disposed on the central shaft drives a pinion gear and is adapted to be shifted axially on the central shaft for selectively engaging the pinion gear with the flywheel of an engine to be cranked.

3 Claims, 1 Drawing Figure

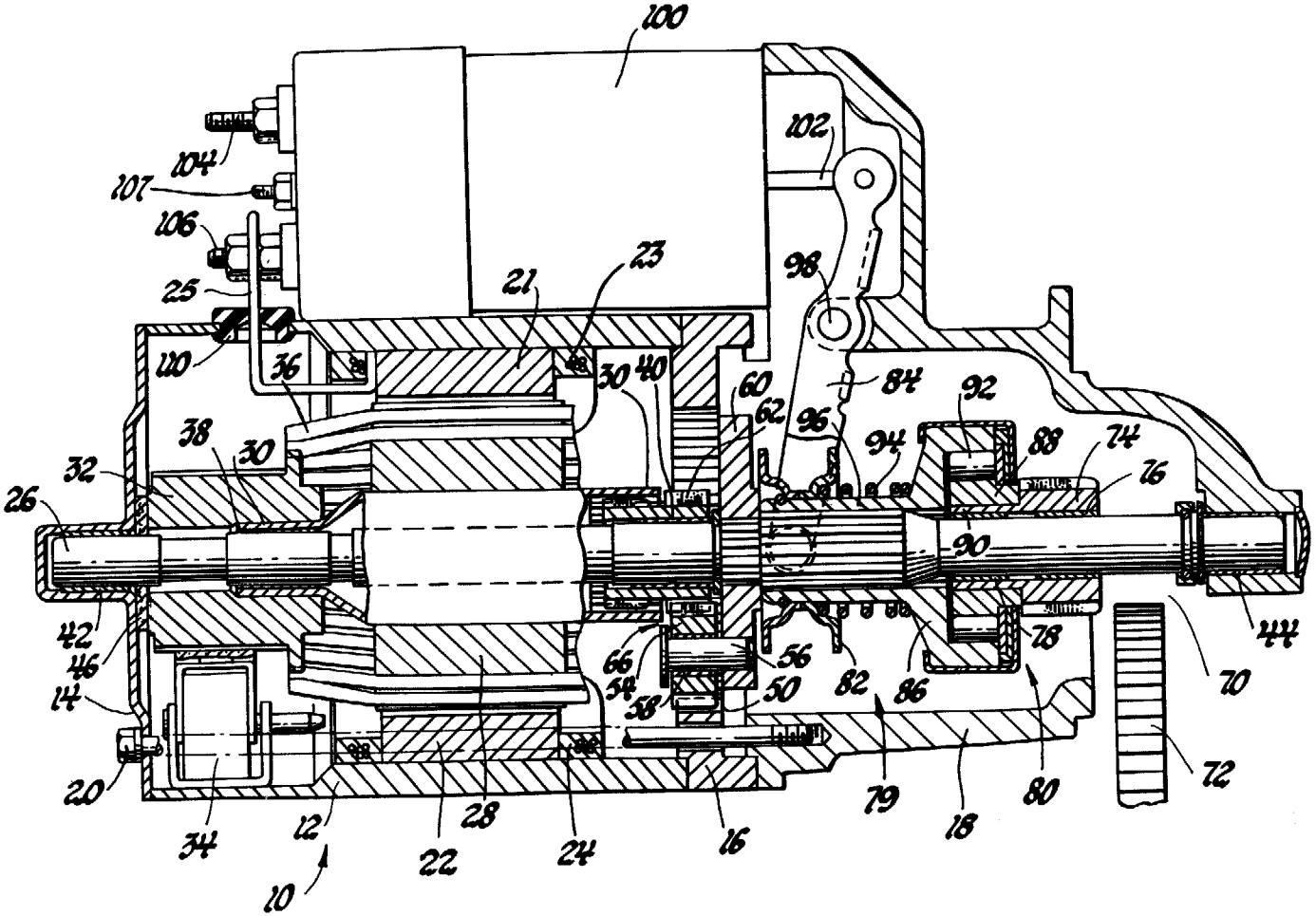

IN-LINE ENGINE CRANKING MOTOR DRIVE HAVING REDUCTION GEAR SET

This invention relates to an electric motor and drive for cranking an internal combustion engine and more particularly to a drive incorporating an in-line reduction gear set.

Generally, electric cranking motor drives may be categorized as either the direct type wherein the motor directly cranks an engine through a pinion gear coupled to the motor armature shaft, or the reduction type wherein a gear set is interposed between the motor and the pinion gear to increase the cranking capability of the drive. Although somewhat more expensive to manufacture, use of the reduction type drive may be desirable since the cranking motor or the vehicle storage battery size or capacity may thereby be reduced without impairing the cranking capability. However, a drawback associated with prior art reduction drives is that the pinion carrying shaft is substantially shorter than with the direct type of drive. Consequently, loading on the shaft is more concentrated, leading to increased wear and premature failure of the bearings which support the shaft. Similar problems would also be experienced with a reduction type drive wherein the pinion gear and the pinion carrying shaft are rotated at significantly different speeds.

Reduction type drives may be further categorized as either the in-line type wherein the pinion carrying shaft is aligned with the motor armature shaft, or the offset type wherein the gear set offsets the pinion carrying shaft from the axis of the armature shaft. Of the above, the in-line type is generally more desirable since it may be built as a more compact unit.

Accordingly, it is an object of this invention to provide an improved in-line reduction type cranking motor drive wherein loading on the pinion carrying shaft is substantially reduced, and wherein the relative motion between the pinion gear and the pinion carrying shaft is similar to that of a conventional direct-type cranking motor drive.

It is a further object of this invention to provide an improved reduction type cranking motor drive wherein the pinion carrying shaft extends the length of the drive housing and is supported at both ends thereby.

It is a further object of this invention to provide an improved reduction type cranking motor drive having an armature carried on a hollow armature shaft wherein the armature shaft is rotatably supported on a portion of a centrally located pinion carrying shaft and wherein the armature shaft drives the pinion carrying shaft through a planetary gear set.

These objects are carried forward with a central shaft rotatably supported at each end by the drive housing and a motor armature assembled on a hollow armature shaft, the armature shaft being rotatably supported by the central shaft. The armature shaft drives the sun gear of an in-line planetary gear set and the planet carrier is drivingly connected to the central shaft to provide gear reduction between it and the armature shaft. The planetary ring gear is formed on the inside of the housing so that the gear set provides additional support for the central shaft. The pinion gear is mounted on the central shaft and a conventional overrunning clutch assembly is used to selectively shift the pinion gear into engagement with the flywheel gear of the engine to be started.

The single drawing FIGURE is a cross-sectional view of a cranking motor and drive in accordance with the teachings of this invention.

Reference numeral 10 generally designates a four pole electric cranking motor supported in a housing assembly comprising motor frame 12, end plate 14, annular housing member 16, and nose piece member 18. Motor pole pieces 21 and 22 are fastened to frame 12, and field windings 23 and 24 are wound around the pole pieces and connected to the other field windings in a conventional manner. The housing members are fastened together by bolts 20 which seat against end plate 14, pass through circular recesses in member 16, and thread into nose piece member 18. Although only one bolt 20 is shown in the figure, there are preferably two such bolts positioned 180° apart and passing between adjacent motor pole pieces. Motor 10 further comprises a solid central shaft 26 and an armature 28 mounted on a hollow armature shaft 30. Commutator 32 is mounted on armature shaft 30 for rotation therewith and cooperates with brush assembly 34 in a well-known manner to supply current to the armature windings which are schematically illustrated by conductors 36. A DC voltage is applied to the various field windings via conductor 25, and a further conductor (not shown) forms a connection between the field windings and brush assembly 34. Armature shaft 30 is rotatably supported by central shaft 26 on sleeve bearings 38 and 40 journaled onto shaft 26. Shaft 26 is supported at end plate 14 by bushing 42 and at nose piece member 18 by bushing 44. Bushing 46 is disposed about central shaft 26 between end plate 14 and commutator 32 for decelerating armature shaft 30 when motor 10 is deenergized.

The interior periphery of annular housing member 16 has a plurality of gear teeth 50 formed thereon which are in meshing engagement with the teeth of planet gears 54. Each planet gear 54 is supported by a pinion 56 extending through a bushing 58 in the bore of the gear. Planet carrier 60 is splined to central shaft 26 and engages each of the pinions 56 to form a driving relationship between planet gears 54 and the shaft 26. Sun gear 62 is attached to hollow armature shaft 30 for rotation therewith, the gear teeth of sun gear 62 being in meshing engagement with the teeth of planet gears 54. It will be appreciated that the above-mentioned elements—namely, sun gear 62, planet gears 54 and annular housing member 16—thus form a planetary gear set 66 whereby hollow armature shaft 30 is adapted to rotatably drive central shaft 26. The fixed speed relationship thereby established between hollow armature shaft 30 and central shaft 26 is determined according to the number of gear teeth on housing member 16, planet gears 54, and sun gear 62. In addition, it will be appreciated that the planetary gear set 66 acts to support central shaft 26 about its midsection.

Nose piece 18 is provided with an opening generally designated by reference numeral 70 for receiving the flywheel gear 72 of an engine to be cranked. Pinion gear 74 is rotatably supported on central shaft 26 by bearings 76 and 78 journaled onto shaft 26, and a pinion advancing mechanism 79 is selectively operable to shift pinion gear 74 axially into engagement with engine flywheel gear 72. Pinion advancing mechanism 79 is a conventional unit and generally comprises a one-way overrunning clutch 80, and a shift collar 82 adapted to receive a shift lever 84 for shifting clutch 80 axially on central shaft 26. The overrunning clutch 80 comprises a driving member 86 internally splined onto central shaft 26, a driven member 88 rigidly fastened to pinion gear sleeve 90, and rollers or sprags 92 cooperating with driving member 86 and driven member 88 in a manner to permit central shaft 26 to rotatably drive pinion gear 74 but to prevent pinion gear 74 from driving central shaft 26 when the engine begins to rotate under its own power. An overrunning clutch of this type is described in detail in the U.S. patent to Critchfield U.S. Pat. No. 2,211,053, issued on Aug. 13, 1940, and is incorporated herein by reference. Spring 94 is disposed about a sleeve portion 96 of clutch driving member 86 and permits pinion gear 74 to yield axially in the event of gear abutment between pinion gear 74 and engine flywheel gear 72.

Shift lever 84 is adapted to pivot about pin 98 to shift pinion advancing mechanism 79 when solenoid/switch mechanism 100 acts on shift lever 84 through connecting rod 102. Solenoid/switch mechanism 100 is a conventional device and operates to pull connecting rod 102 to the left as viewed in the drawing and to electrically bridge terminals 104 and 106 in response to the application of battery voltage to terminal 107. Typically, a vehicle ignition switch is used to apply battery voltage to terminal 107, and the battery is connected directly to terminal 104. A device meeting the abovementioned specifications is described in detail in the U.S. patent to Dyer, U.S. Pat. No. 2,287,791 issued June 30, 1942, and is incorporated herein by reference. Conductor 25 passes through grommet 110 in motor housing 12 and is connected to terminal 106.

The operation of the cranking motor and drive of this invention will now be described. When the vehicle ignition switch (not shown) applies battery voltage to terminal 107 of solenoid/switch mechanism 100, shift lever connecting rod 102 is pulled to the left as viewed in the drawing to advance pinion gear 74 into engagement with engine flywheel gear 72, and an electrical connection is made between switch terminals 104 and 106 to energize cranking motor 10. Hollow armature shaft 30 thereby drives sun gear 62 of planetary gear set 66, and planet carrier 60 transmits the rotation of planet gears 54 to central shaft 26. Overrunning clutch assembly 80 couples the rotation of central shaft 26 to pinion gear 74 for cranking the engine to be started, and when the engine begins to run under its own power, clutch mechanism 80 freewheels to prevent the engine from overspeeding motor 10. When battery voltage is no longer applied to terminal 107 of solenoid/switch mechanism 100, connecting arm 102 is moved to the right as viewed in FIG. 1 to disengage pinion gear 74 from engine flywheel 72. At the same time, contacts 104 and 106 are opened to deenergize motor 10 and bushing 46 decelerates armature shaft 30.

The cranking motor and drive of this invention thus provide a fixed gear reduction between armature shaft 30 and pinion gear 74. The pinion gear 74 and the armature 28 are supported on central shaft 26 which extends the length of the motor assembly and which is supported at both ends by the housing and at its midsection by planetary gear set 66. The cranking motor and drive of this invention is capable of using a conventional pinion advancing mechanism 79 and solenoid/switch mechanism 100. As a result, the advantages of compactness, gear reduction and evenly distributed loading along shaft 26 are achieved with a minimum of additional expense over that of a conventional cranking motor drive.

The embodiments of the invention in which an exclusive property or privilege is claimed are defined as follows:

1. An electric cranking motor drive for an internal combustion engine comprising: a housing, a central shaft rotatably supported at both ends by said housing, an electric motor having an armature carried on a hollow armature shaft, said armature shaft being disposed about a portion of said central shaft and rotatably supported thereon, means defining a gear set connected between said armature shaft and said central shaft for establishing a power path through which said armature shaft may drive said central shaft, and a pinion gear shiftably coupled to said central shaft so as to be driven thereby, said pinion gear being adapted to be shifted into engagement with the flywheel gear of said engine for cranking.

2. An electric cranking motor drive for an internal combustion engine comprising: a housing, a central shaft rotatably supported at both ends by said housing, an electric motor having an armature carried on a hollow armature shaft, said armature shaft being disposed about a portion of said central shaft and rotatably supported thereon, a planetary gear set comprising a sun gear connected to said armature shaft to be driven thereby, a ring gear secured to said housing, planet gears engaging said sun gear and said ring gear, and a planet carrier connected to said planet gears and to said central shaft to form a driving relationship therebetween, whereby said planetary gear set supports said central shaft and establishes a power path through which said armature shaft may drive said central shaft, and a pinion gear shiftably coupled to said central shaft so as to be driven thereby, said pinion gear being adapted to be shifted into engagement with the flywheel gear of said engine for cranking.

3. An electric cranking motor drive for an internal combustion engine comprising: an electric motor having a central shaft and a hollow armature shaft rotatably supported about a portion of said central shaft, a first housing section disposed about said motor and supporting one end of said central shaft, planetary gear reduction means including a sun gear connected to said armature shaft to be driven thereby, a ring gear defined by a second housing section coupled to said first housing section, planet gears engaging said sun gear and said ring gear, and a planet carrier connected to said planet gears and to said central shaft for forming a driving relationship therebetween, whereby said planetary gear set supports said central shaft and establishes a power path through which said armature shaft may drive said central shaft, a pinion gear and driving means therefor shiftably coupled to said central shaft so as to be rotatably driven thereby, said pinion gear being adapted to be shifted into engagement with the flywheel gear of said engine for cranking, and a third housing section disposed about said pinion gear and said driving means, said third housing section being coupled to said second housing section and supporting the other end of said central shaft, whereby said central shaft which drives said pinion gear is supported at each of said first, second, and third housing sections.

* * * * *